US010687628B1

(12) United States Patent
Kite

(10) Patent No.: US 10,687,628 B1
(45) Date of Patent: Jun. 23, 2020

(54) BEACH CHAIR SECURING DEVICE

(71) Applicant: Eric Kite, Philadelphia, PA (US)

(72) Inventor: Eric Kite, Philadelphia, PA (US)

( * ) Notice: Subject to any disclaimer, the term of this patent is extended or adjusted under 35 U.S.C. 154(b) by 0 days.

(21) Appl. No.: 16/386,332

(22) Filed: Apr. 17, 2019

Related U.S. Application Data

(60) Provisional application No. 62/659,725, filed on Apr. 19, 2018.

(51) Int. Cl.
*A47C 7/62* (2006.01)
*A47C 1/14* (2006.01)
(Continued)

(52) U.S. Cl.
CPC ..... *A47C 7/62* (2013.01); *A47C 1/14* (2013.01); *A47C 7/66* (2013.01); *E02D 5/80* (2013.01); *E02D 5/801* (2013.01); *E04H 12/2215* (2013.01); *E04H 12/2223* (2013.01); *A45B 2023/0012* (2013.01)

(58) Field of Classification Search
CPC .. A47C 1/14; E02D 5/80; E02D 5/801; A45B 2023/0012; E04H 12/2215; E04H 12/2223
USPC ..... 297/463.1; 5/417; 135/118; 52/156, 52/157, 165; 248/530, 545
See application file for complete search history.

(56) References Cited

U.S. PATENT DOCUMENTS 1,628,472 A * 5/1927 Perry ..... A47C 1/146 297/351
3,220,766 A * 11/1965 Kates ..... A01M 31/025 297/184.16
(Continued)

FOREIGN PATENT DOCUMENTS

DE 19839770 A1 * 3/2000 ..... E04H 12/2223
DE 102010062272 A1 * 6/2012 ..... E04H 12/2269
DE 19839770 2/2018
EP 2505718 A1 * 10/2012 ..... A01G 13/0293
WO 9732088 9/1997

OTHER PUBLICATIONS https://www.amazon.com/Beachr-Beach-Umbrella-Anchor-Strong/dp/B014RQZZC0. Feb. 27, 2018.

*Primary Examiner* — Robert Canfield
(74) *Attorney, Agent, or Firm* — Joseph E. Maenner; Maenner & Associates, LLC

(57) ABSTRACT

A beach chair securing assembly includes an outer insert having a hollow leg having a pointed distal tip and a proximal opening. The hollow leg has a helical thread assembly surrounding an exterior thereof and extending partially up the length of the leg. A generally annular lower plate surrounds the proximal opening and has a pair of diametrically opposed clamps. Each clamp includes a vertical portion extending upwardly from the lower plate and a connecting horizontal portion extending generally parallel to the lower plate. An inner insert has a distal shaft sized to fit into the hollow leg and an upper plate connected to the distal shaft. The upper plate has a top surface having a saddle defined by a generally arcuate concave valley extending along a longitudinal axis. A pair of diametrically opposed ridges extends upwardly from either side of the valley. Each ridge includes an upwardly extending eyelet having a through-hole extending therethrough such that the through-holes are axially aligned. A pair of diametrically opposed catches extending along the longitudinal axis and are sized and shaped to engage one of the clamps.

18 Claims, 17 Drawing Sheets

(51) Int. Cl.

| | |
|---|---|
| ***E02D 5/80*** | (2006.01) |
| ***E04H 12/22*** | (2006.01) |
| ***A47C 7/66*** | (2006.01) |
| *A45B 23/00* | (2006.01) |

(56) References Cited

U.S. PATENT DOCUMENTS

| | | | | |
|---|---|---|---|---|
| 3,967,694 | A * | 7/1976 | Woolfolk, Sr. | A01K 97/22 182/82 |
| 4,318,567 | A | 3/1982 | Guthier | |
| 5,087,095 | A * | 2/1992 | McFate | A47C 1/14 224/155 |
| 5,110,184 | A * | 5/1992 | Stein | A47C 1/14 297/184.16 |
| 5,501,086 | A | 3/1996 | Sherlock | |
| 5,662,304 | A | 9/1997 | McDaniel | |
| 6,082,697 | A | 7/2000 | Grunfeld | |
| 6,199,569 | B1 | 3/2001 | Gibson | |
| 6,371,139 | B1 | 4/2002 | Simchori | |
| 6,629,389 | B1 | 10/2003 | Rust | |
| 7,559,218 | B2 | 7/2009 | Soudan, Jr. | |
| 7,891,629 | B2 | 2/2011 | Moyers | |
| 8,465,090 | B1 * | 6/2013 | O'Connor | A47C 7/62 297/184.16 |
| 8,656,651 | B1 | 2/2014 | Scarano, Jr. et al. | |
| 8,985,061 | B2 * | 3/2015 | Royals | A01K 1/04 119/786 |
| 9,968,167 | B2 * | 5/2018 | Volin | A45B 17/00 |
| 2002/0000076 | A1 | 1/2002 | Goeku | |
| 2002/0145316 | A1 * | 10/2002 | Oliver | A01K 97/10 297/217.1 |
| 2006/0101877 | A1 | 5/2006 | Orum et al. | |
| 2008/0283105 | A1 | 11/2008 | DuBose, III | |
| 2014/0203619 | A1 | 7/2014 | Dapra | |

* cited by examiner

BEACH CHAIR SECURING DEVICE

CROSS-REFERENCE TO RELATED APPLICATION

The present application claims priority from U.S. Provisional Patent Application Ser. No. 62/659,725, filed on Apr. 19, 2018, which is incorporated herein by reference in its entirety.

BACKGROUND OF THE INVENTION

Beach goers typically bring beach chairs, umbrellas, coolers, and other items with them to the beach. Beach chairs tend to have pouches and racks on the back of them for storing things like sunscreen and for hanging towels to dry. When the beachgoer is sitting in the chair, the weight of the beachgoer keeps the chair in place. However, when the beachgoer gets out of the chair, the weight of the items in and on the back of the chair, along with the wind, tends to topple the chair over. Similar issues occur at other locations than the beach. For example, people use lightweight chairs at other outdoor events, such as sporting competitions, concerts, and picnics. These chairs can also topple over when not being sat upon.

It would be beneficial to provide a device that can secure a beach chair or other lightweight chair so that it does not topple when it is not occupied.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, the present invention provides a beach chair securing assembly including an outer insert having a hollow leg having a pointed distal tip and a proximal opening. The hollow leg has a helical thread assembly surrounding an exterior thereof and extending partially up the length of the leg. A generally annular lower plate surrounds the proximal opening and has a pair of diametrically opposed clamps. Each clamp includes a vertical portion extending upwardly from the lower plate and a connecting horizontal portion extending generally parallel to the lower plate. An inner insert has a distal shaft sized to fit into the hollow leg and an upper plate connected to the distal shaft. The upper plate has a top surface having a saddle defined by a generally arcuate concave valley extending along a longitudinal axis. A pair of diametrically opposed ridges extends upwardly from either side of the valley. Each ridge includes an upwardly extending eyelet having a through-hole extending therethrough such that the through-holes are axially aligned. A pair of diametrically opposed catches are sized and shaped to engage one of the clamps.

BRIEF DESCRIPTION OF THE DRAWINGS

Aspects, features, and advantages of the present invention will become more fully apparent from the following detailed description, the appended claims, and the accompanying drawings in which like reference numerals identify similar or identical elements.

DETAILED DESCRIPTION OF THE INVENTION

Figure 1:
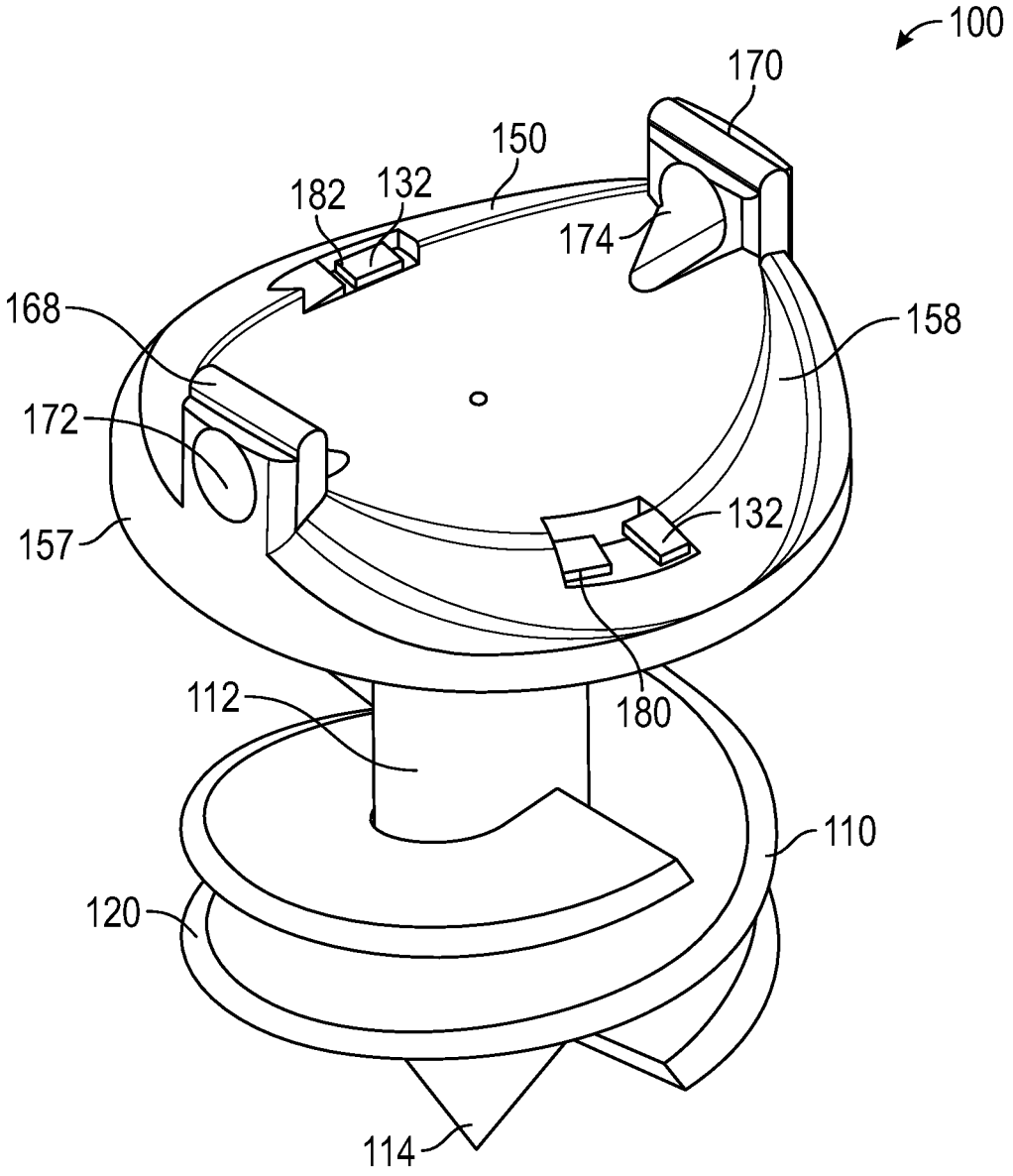
FIG. 1 shows a perspective view of a beach chair securing assembly according to an exemplary embodiment of the present invention.
Figure 1A:
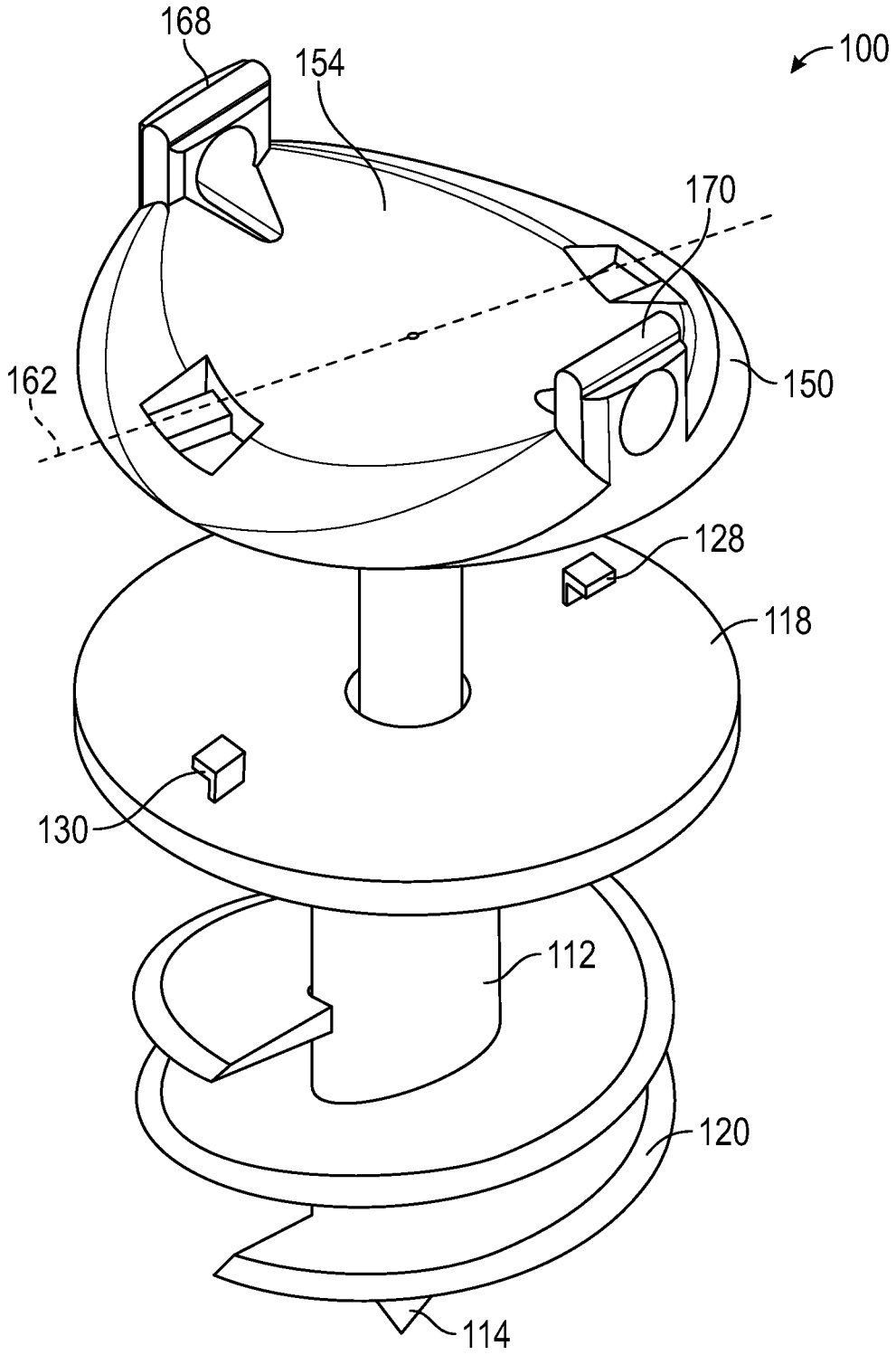
FIG. 1A shows a perspective view of the assembly of FIG. 1, partially disassembled.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary"

is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

FIG. 1 shows a beach chair securing assembly 100 ("assembly 100") according to a first exemplary embodiment of the present invention. Assembly 100 is used to secure a beach chair (not shown) or other device from tipping over or being blown over when not being sat on. Assembly 100 is inserted into soil, sand, or other type of natural ground and the chair or other item is strapped to assembly 100.

Assembly 100 includes two separable insert members that can be used for different soil conditions. Outer member 110 can be inserted into loose or sandy soil, such as at the beach, and inner member 150 can be inserted into more compact soil. For either type of soil, it is envisioned that inner member 150 will always be used to secure a chair. This means that inner member 150 can be used with or without outer member 110.

Figure 2:
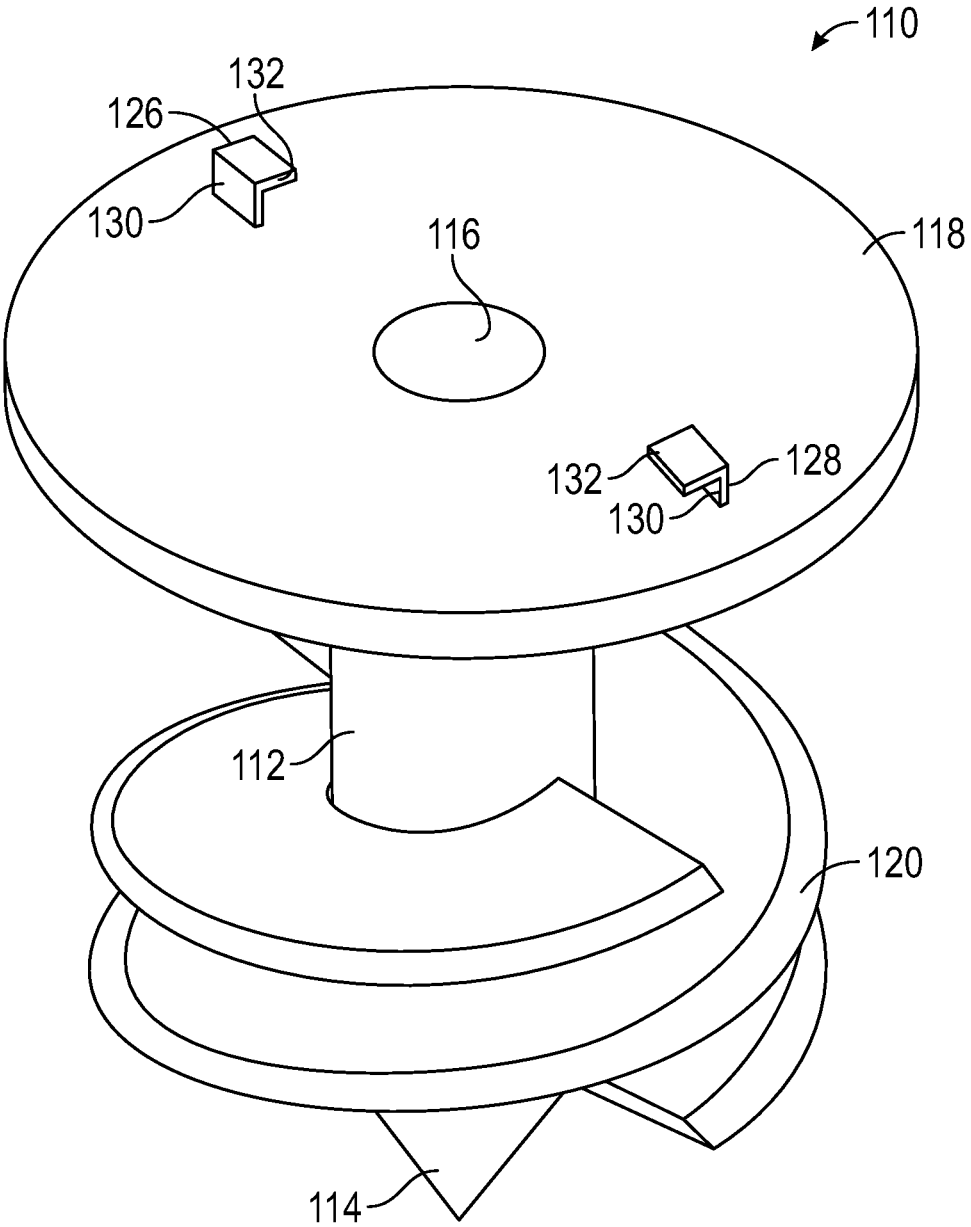
FIG. 2 shows a perspective view of an outer member of the assembly of FIG. 1.
Figure 3:
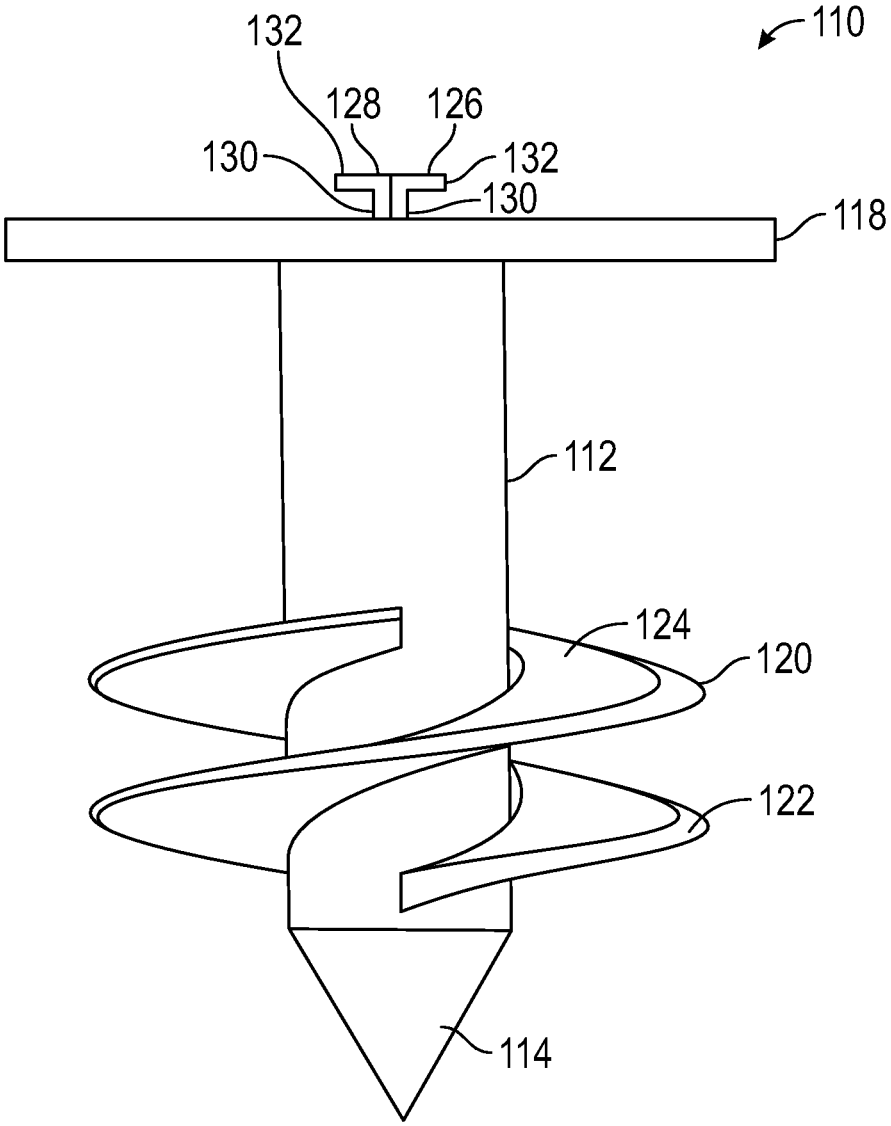
FIG. 3 shows a side elevational view of the outer member of FIG. 2.
Figure 4:
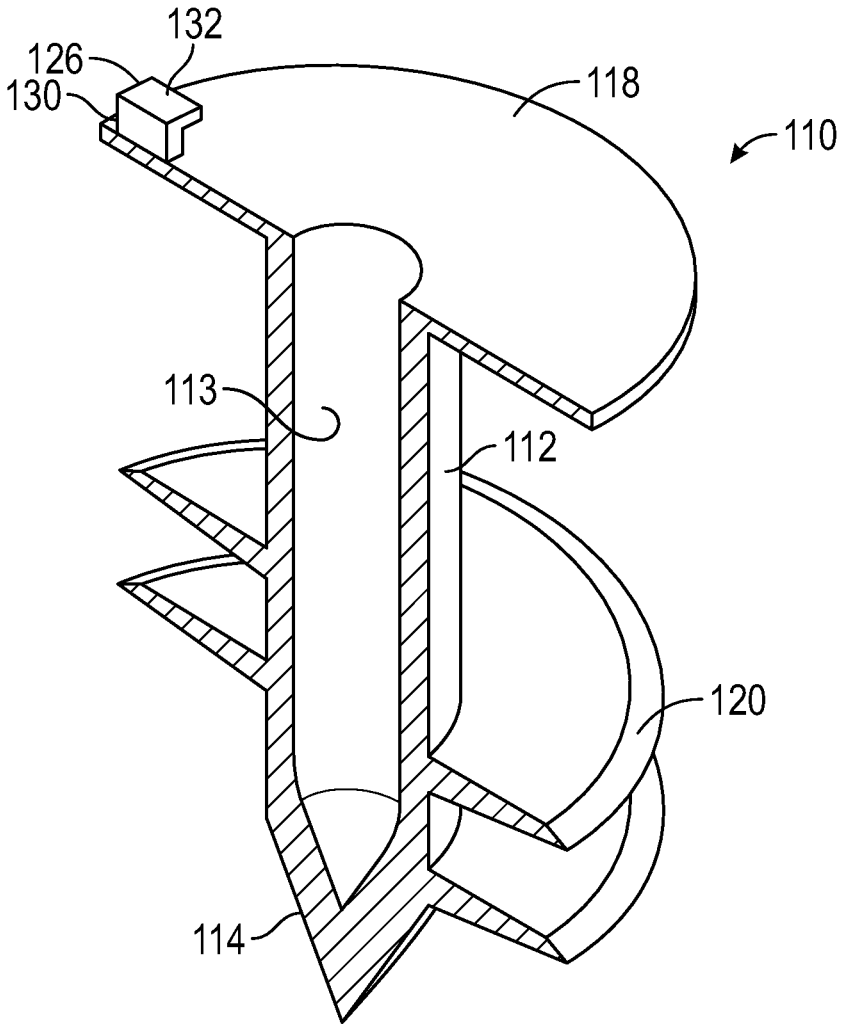
FIG. 4 shows a perspective view, in section of the outer member of FIG. 2.

Referring to FIGS. 2-4, outer member 110 includes a hollow leg 112 having a pointed distal tip 114 and a proximal opening 116. Leg 112 includes a cavity 113 extending distally from proximal opening 116 toward tip 114. A generally annular lower plate 118 surrounds proximal opening 116. A helical thread assembly 120 surrounds the exterior of and extends generally partially up the length of leg 112 from distal tip 114 to about half the length of leg 112.

Helical thread assembly 120 can be a double helix, with threads 122, 124, as shown in FIG. 3. Alternatively, helical thread assembly 120 can be a single helix or have more than two helices. Distal tip 114 is used to pierce the soil, while helical thread assembly 120 is used to "bite" into loose or sandy soil to secure outer member 110 in the soil.

Lower plate 118 includes a pair of diametrically opposed clamps 126, 128 that are used to "grip" inner member 150, as will be explained in more detail below. Each clamp 126, 128 includes a vertical portion 130 that extends upwardly from lower plate 118 and a connecting horizontal portion 132 that extends generally parallel to lower plate 118. Horizontal portions 132 extend in a clockwise direction around lower plate 118 from vertical portions 130. Clamps 126, 128 can be stamped from lower plate 118 if lower plate 118 is constructed from a metal, or molded into lower plate 118 is lower plate 118 is constructed from a polymer.

Figure 5:
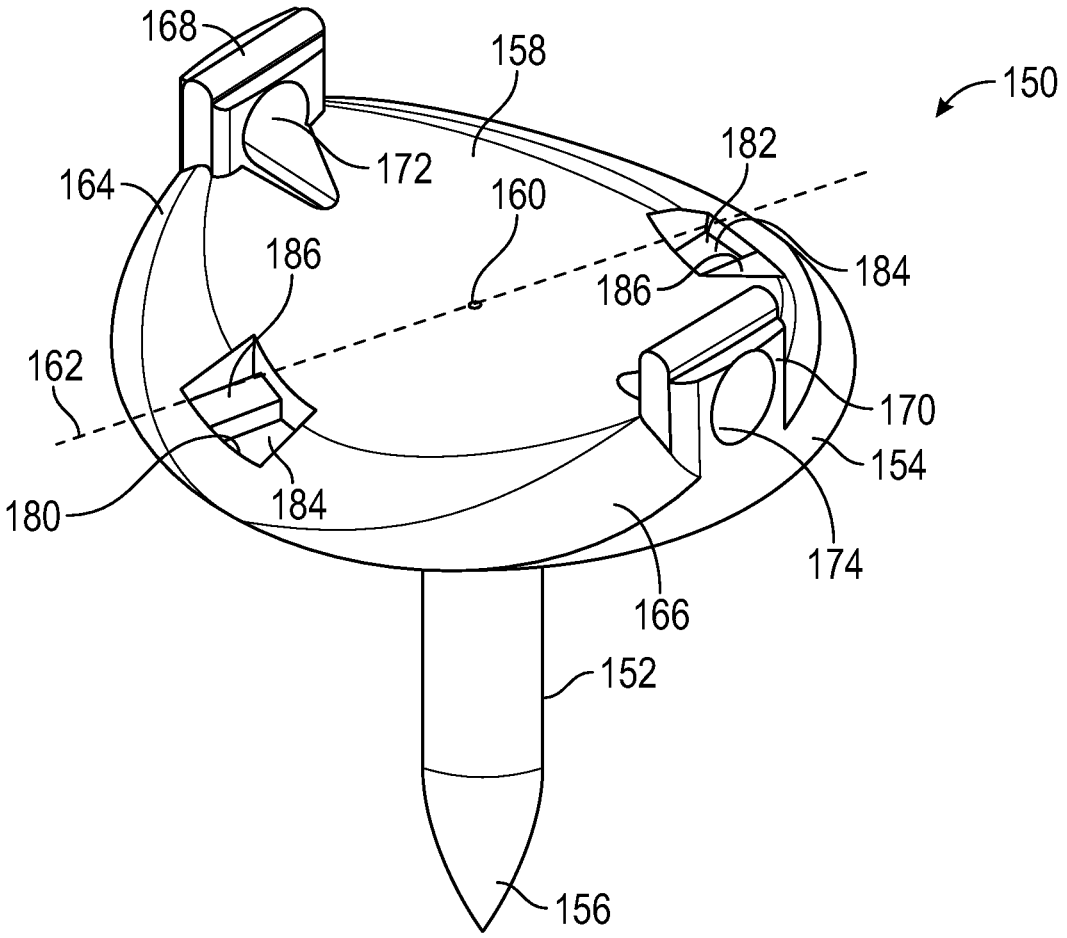
FIG. 5 shows a perspective view of an inner member of the assembly of FIG. 1.
Figure 6:
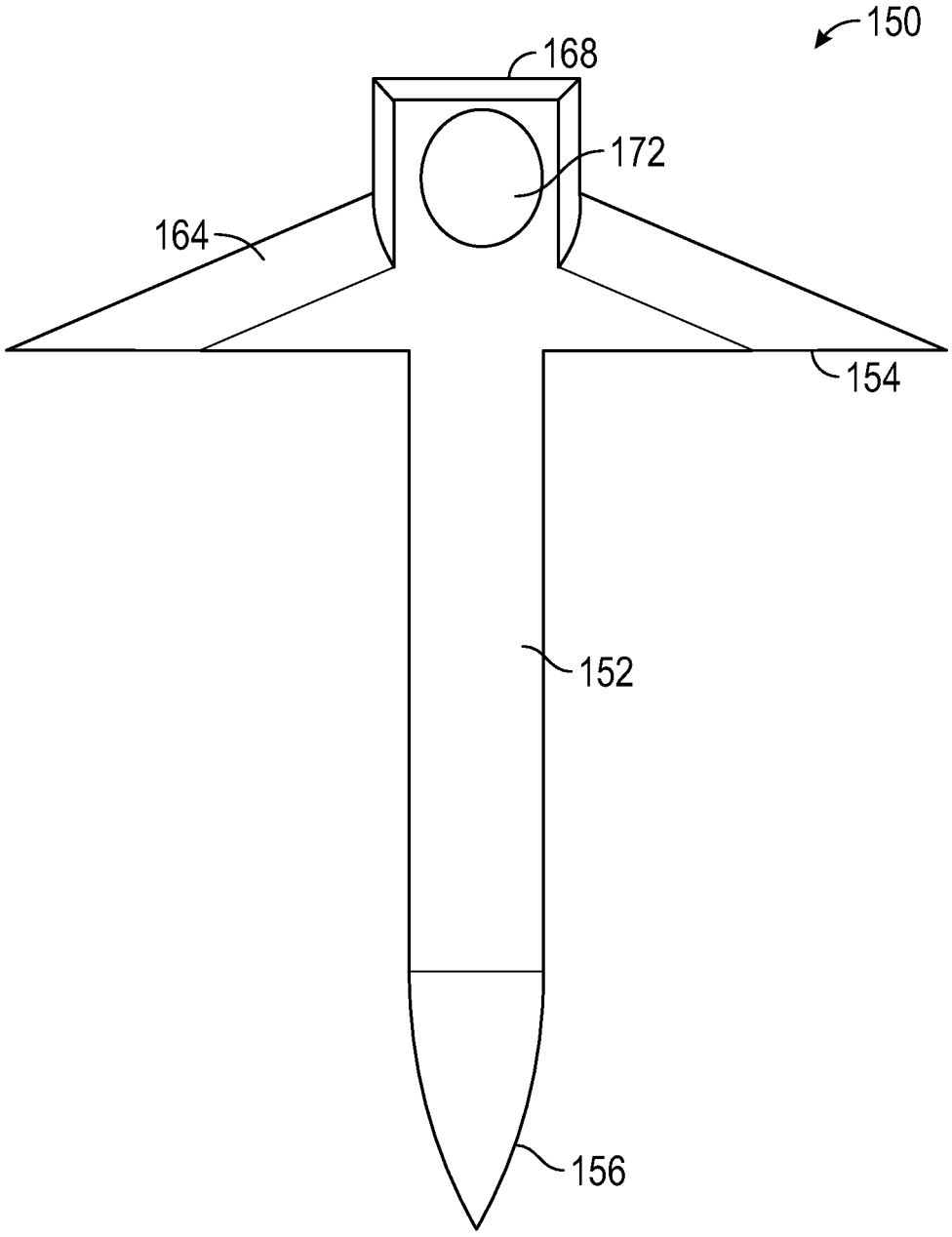
FIG. 6 shows a side elevational view of the inner member of FIG. 5.
Figure 7:
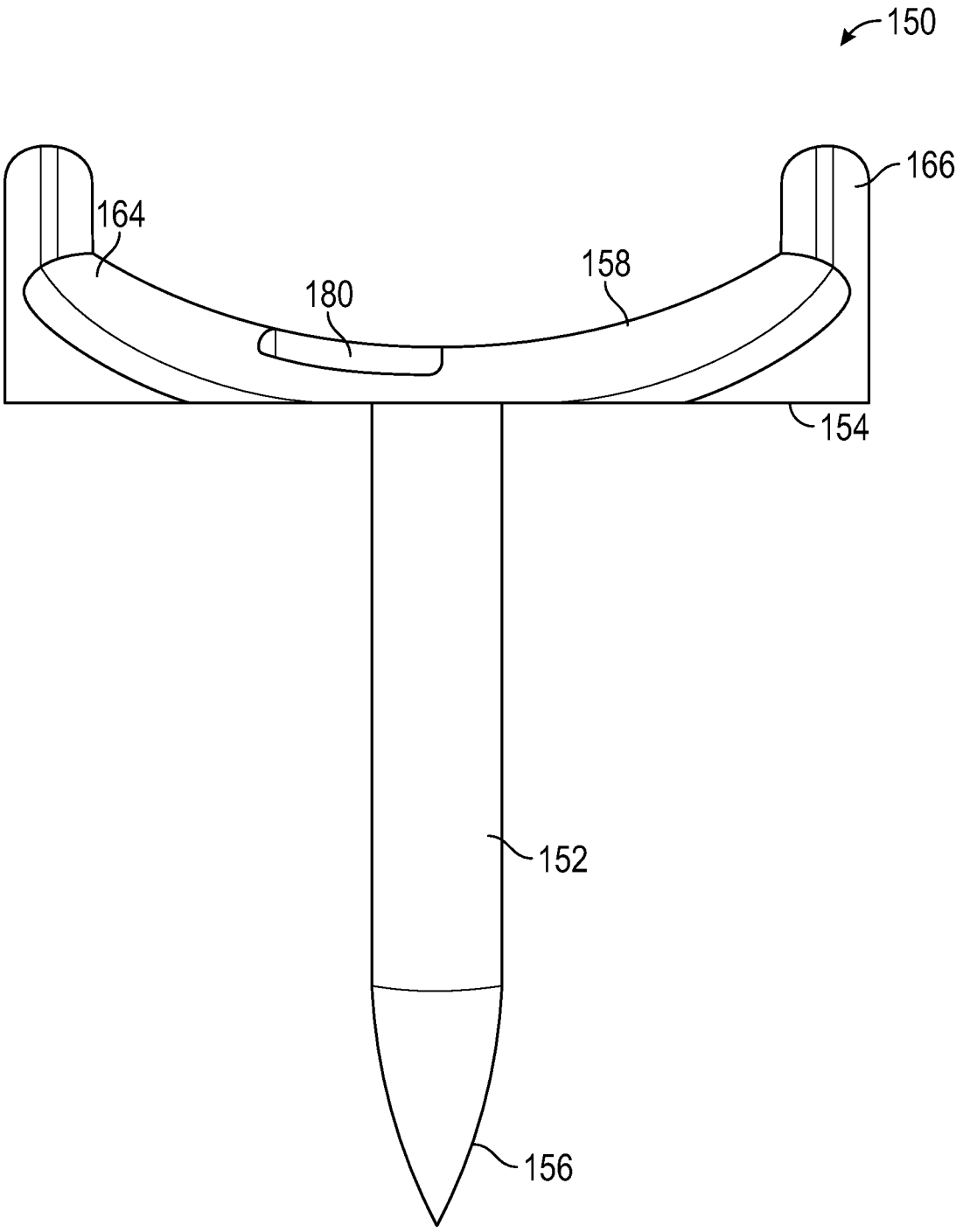
FIG. 7 shows a front elevational views of the inner member of FIG. 5.

Referring to FIGS. 5-7, inner member 150 includes a distal shaft 152 connected to an upper plate 154. Unlike leg 112, distal shaft 152 has no threads, but is typically a smooth cylindrical shaft that terminates in a pointed distal tip 156. Distal shaft 152 is sized to fit onto cavity 113 so that upper plate 154 can rest on top of lower plate 118.

Upper plate 154 includes a top surface 158 having a saddle defined by a generally arcuate concave valley 160 extending along a longitudinal axis 162. Diametrically opposed ridges 164, 166 extend upwardly from either side of valley 160. Each ridge 164, 166 includes an upwardly extending eyelet 168, 170, respectively. Each eyelet 168, 170 has a through-hole 172, 174, respectively, extending therethrough. Through-holes 172, 174 are axially aligned such that a rod or other straight object (not shown) can be threaded through both through-holes 172, 174. Alternatively, although not shown, a flexible strap, such as a nylon or fabric cord, can be threaded through through-holes 172, 174.

A pair of diametrically opposed catches 180, 182 extends along longitudinal axis 162, about 90 degrees around the circumference of upper plate 154 from eyelets 168, 170. Each catch 180, 182 is sized and shaped to engage one of the clamps 126, 128. Catches 180, 182 each include a through-opening 184 through upper plate 154 sized to allow the horizontal portions 132 of clamps 126, 128 to extend therethrough. A recessed ridge 186 is adjacent to each through-opening 184 and is sized to allow the horizontal portions 132 to engage such that the lower surface of horizontal portions 132 engage or are at least slightly above the respective ridges 186. Vertical portions 130 of catches 126, 128 are sufficiently short such that horizontal portions 132 of clamps 126, 128 do not extend vertically above the top surface 158 of the upper plate 154.

Similar to the horizontal portions 132 with respect to vertical portions 130, ridges 186 extend in a clockwise direction around upper plate 154 from through-openings 184. When the horizontal portions 132 are inserted into through-openings 184, inner member 150 can be rotated clockwise with respect to outer member 110 for clamps 126, 128 to engage their respective catch 180, 182.

Figure 8:
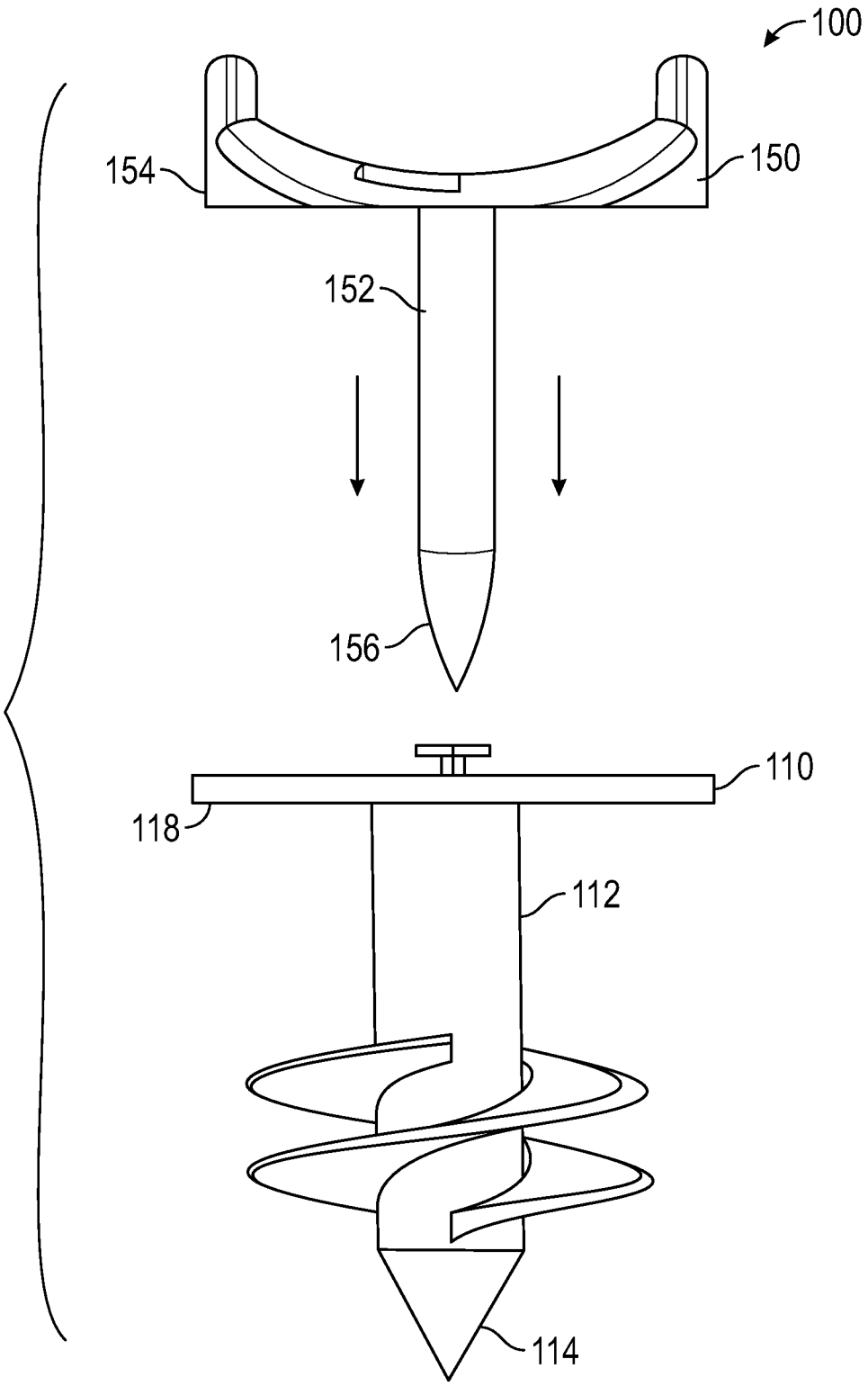
FIG. 8 shows a side elevational view of the inner member of FIG. 5 being inserted into the outer member of FIG. 2.
Figure 9:
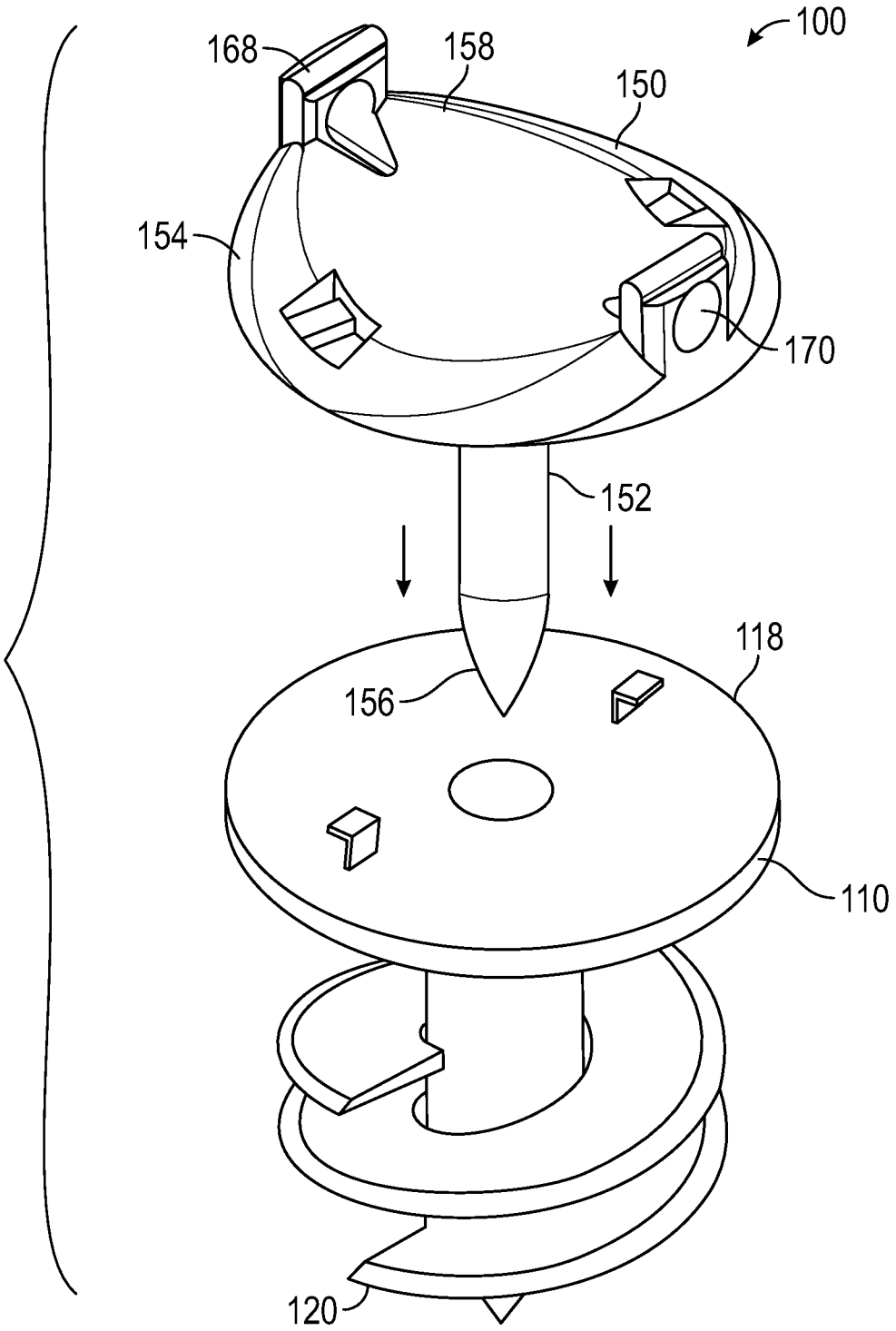
FIG. 9 shows a perspective view of the inner member of FIG. 5 being inserted into the outer member of FIG. 2.

Referring to FIGS. 8 and 9, to use assembly 100, a user first determines the type of soil into which he/she intends to insert assembly 100. If the soil is sandy, the outer member 110 is typically selected and, if the soil is dirt or relatively more dense than sand, the outer member 110 is not used and the inner member 150 is inserted directly into the soil.

For sandy soil, the entire assembly 100 can be inserted as a unit. The clamps 126, 128 are aligned with respective through-openings 184 and inserted through through-openings 184. The distal tip 114 of the leg 112 is inserted into the soil and the assembly 100 is simultaneously rotated and pushed downward so that the threads 120 engage the soil and screw the outer insert 110 into the soil until lower plate 118 engages the soil. As the assembly 100 is being inserted, the vertical portion 130 of each of the clamps 126, 128 engages the upper plate 154 adjacent to the through-openings 184 so that inner member 150 and outer member 110 rotate together. Inner member 150 (with outer member 110) can be rotated by inserting a rod (nor shown) into through-openings 172 in eyelets 168, 170 and used as a lever to assist in rotating assembly 100.

If outer member 110 is not used, inner member 150 can be used on its own by placing tip 156 into the soil and vertically pushing shaft 152 into the soil until upper plate 154 engages the soil.

Next, regardless of whether or not outer member 110 is used, the horizontal leg of a chair (not shown) can be placed on the top surface 158 of the upper plate 154, generally along the axis 162. The saddle can be sufficiently deep such that the horizontal leg extends below the bottom of the through-holes 172 in the eyelets 168, 170 such that a rod (not shown) can be threaded through the through-holes 172 to secure the horizontal leg between the top surface 158 of the upper plate and the rod, thereby preventing the horizontal leg from moving and preventing the chair from tipping or being blown over.

For chairs that do not have a horizontal leg proximate to the soil or for items that are desired to be secured that do not have legs (coolers, backpacks, etc.), a strap (not shown) can be releasably or permanently connected to eyelet 168 and strung over the item to be secured, and releasably secured to eyelet 170. Such connections are various and well known, including clips, hook and loop fasteners, snaps, buttons, and do not need to be discussed in detail.

After use, the rod or strap is removed from the eyelets 168, 170. If only inner member 150 is used, inner member 150 can be vertically pulled from the soil. If outer member 110 is also used, inner member 150 is rotated counter clockwise. Each ridge 186 engages a respective vertical portion 130, with horizontal portion 132 rotated above the respective ridge 186 so that outer member 110 also rotates with inner member 150 so that outer member 110 is "unscrewed" from the soil.

Figure 10:
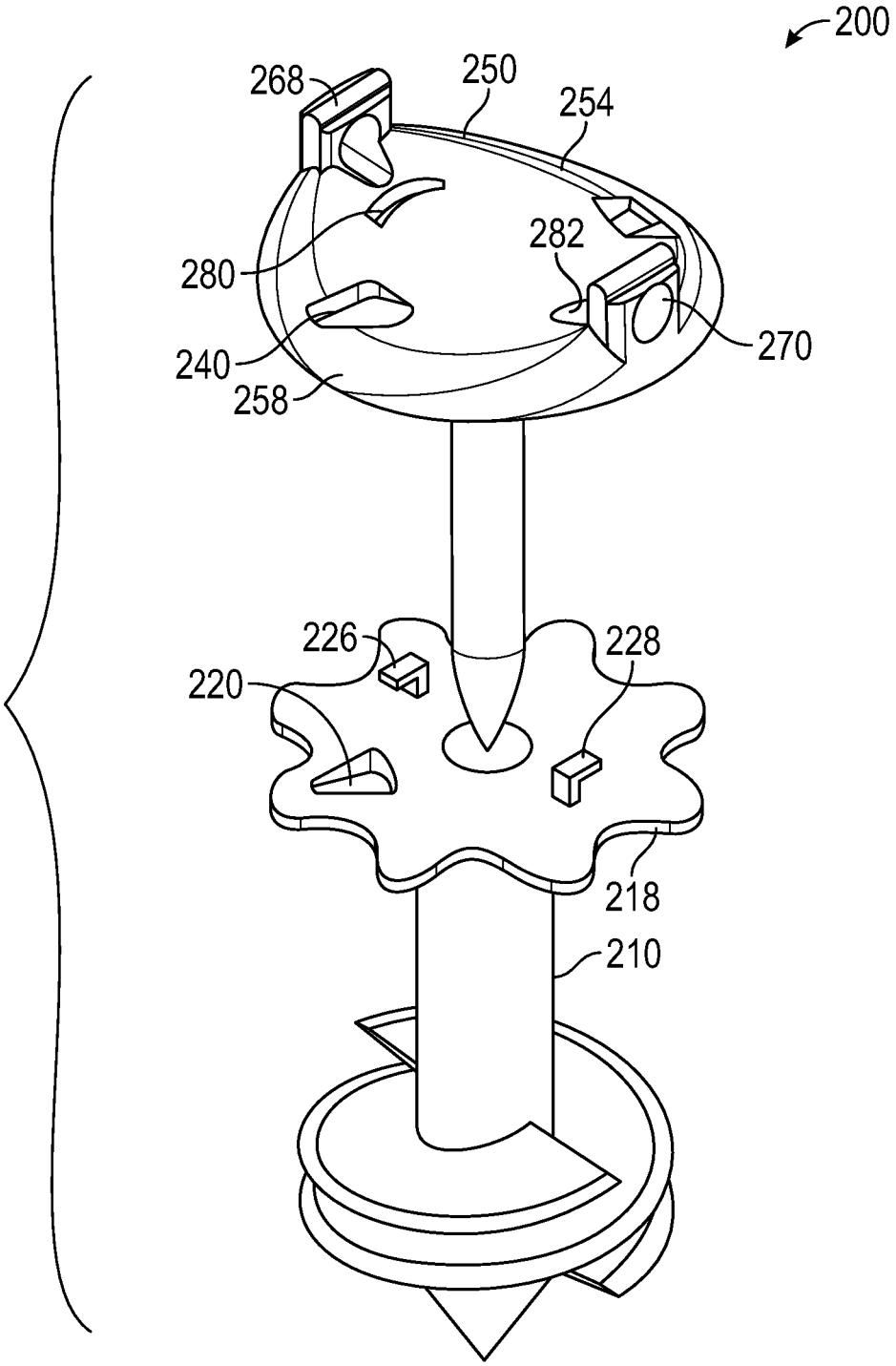
FIG. 10 is an exploded perspective view of a beach chair securing assembly according to an alternative exemplary embodiment of the present invention.
Figure 11:
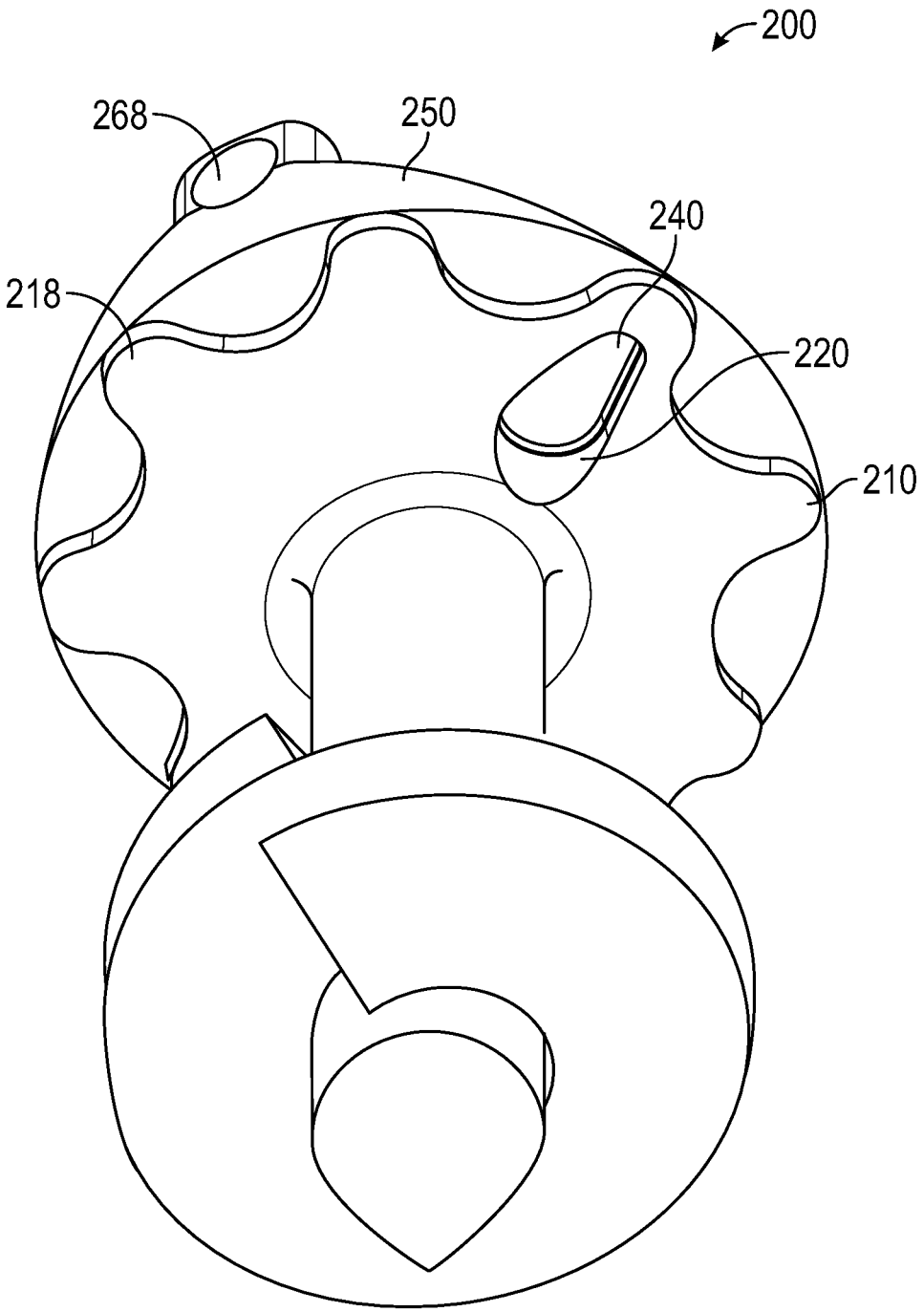
FIG. 11 is a lower perspective view of the assembly of FIG. 10.

An alternative embodiment of a beach chair securing assembly 200 ("assembly 200") according to the present invention is shown in FIGS. 10 and 11. Assembly 200 includes an outer member 210 that includes a scalloped lower plate 218 that provides finger grips to allow a user to more easily rotate outer member 210 into or out of soil. Additionally, lower plate 218 includes a generally teardrop shaped cutout 220 formed therein.

Teardrop shaped cutout 220 mates with a corresponding teardrop shaped cutout 240 formed in upper plate 254 of an inner member 250. When inner member 250 is inserted into outer member 210, teardrop shaped cutouts 220, 240 align so that a use can insert a retaining device, such as a carabiner clip (not shown), therethrough to secure the inner member 250 to the outer member 210 for transport.

Additionally, diametrically opposed catches 280, 282 extend co-linearly with eyelets 268, 270 to allow for teardrop shaped cutout 240 to be located within a generally arcuate concave valley 260 of the upper surface 258 when clamps 226, 228 are inserted through catches 280, 282 and rotated to secure to catches 280, 282.

Figure 12:
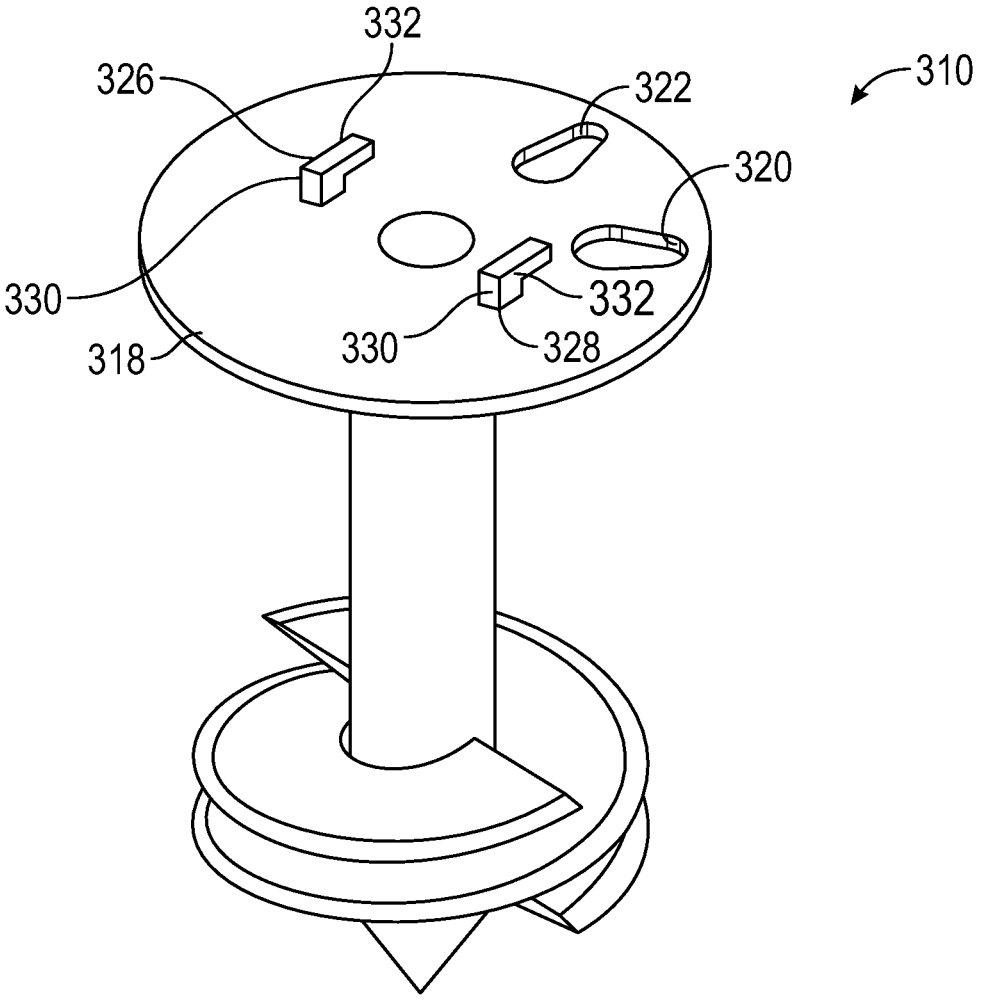
FIG. 12 is a perspective view of an outer member of a beach chair securing assembly according to another alternative exemplary embodiment of the present invention.
Figure 13:
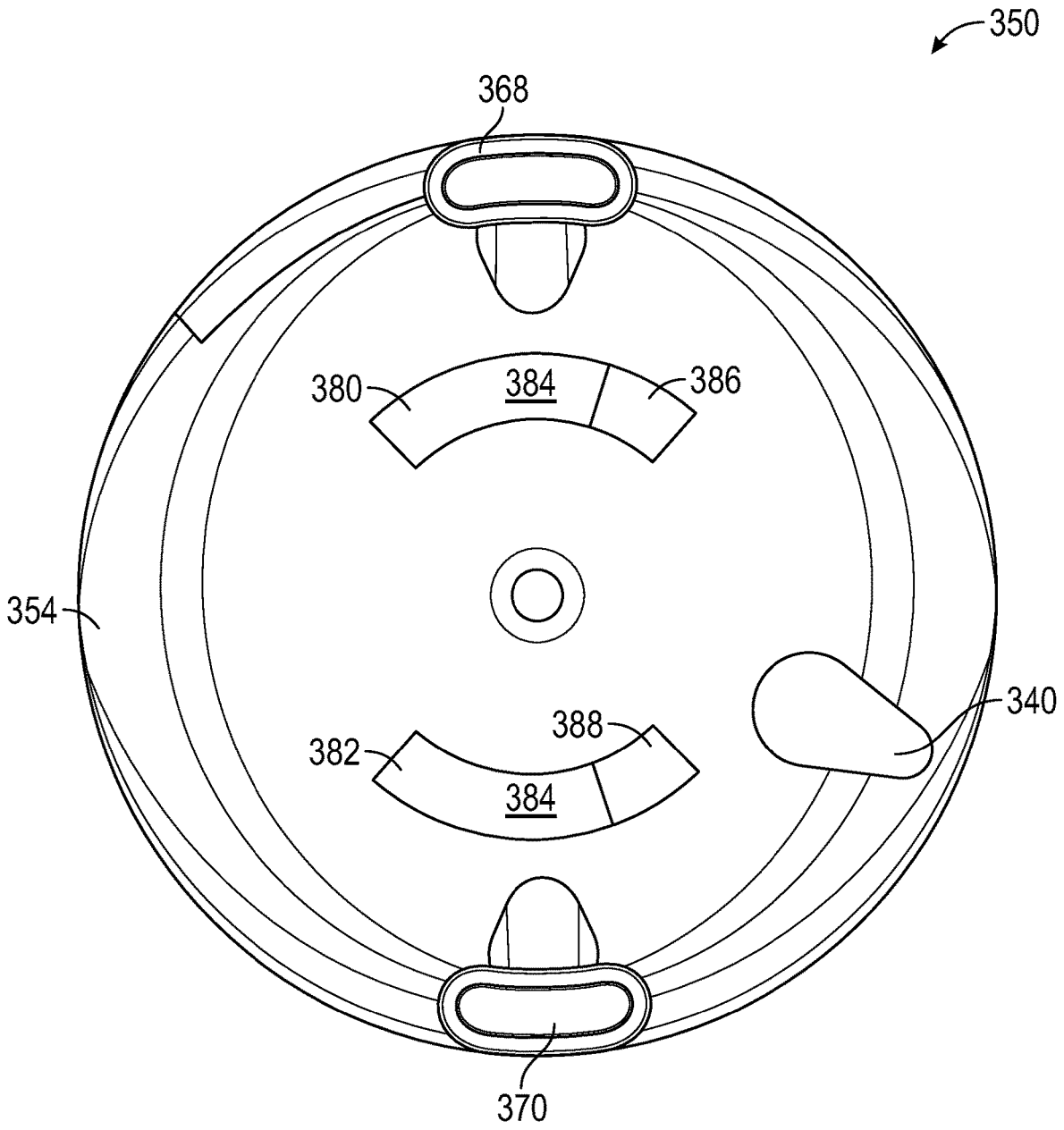
FIG. 13 is a top plan view of an inner member of the assembly.

An alternative embodiment of a beach chair securing assembly 300 ("assembly 300") according to the present invention is shown in FIGS. 12-16. Assembly 300 includes an outer member 310, shown in FIG. 12. Outer member 310 is similar to outer member 110, but includes diametrically opposed clamps 326, 328 that are used to "grip" an inner member 350, as will be explained in more detail below. Each clamp 326, 328 includes a vertical portion 330 that extends upwardly from a lower plate 318 and a connecting horizontal portion 332 that extends generally parallel to lower plate 318. Horizontal portions 332 face the same direction. As shown in FIG. 12, horizontal portions 332 are both facing generally to the right.

Additionally, while outer member 210 includes a single teardrop shaped cutout 220, outer member 310 includes two teardrop shaped cutouts 320, 322.

Inner member 350 includes a single teardrop shaped cutout 340. A pair of diametrically opposed catches 380, 382 extends co-linearly with eyelets 368, 370. Each catch 380, 382 is sized and shaped to engage one of the clamps 326, 328. Catches 380, 382 each include a generally arcuate through-opening 384 through upper plate 354 sized to allow the horizontal portions 332 of clamps 326, 328 to extend therethrough. Recessed ridges 386, 388 are provided in each catch 380, 382 adjacent to each through-opening 384 and are sized to allow the horizontal portions 332 to engage such that the lower surface of horizontal portions 332 engage or are at least slightly above the respective ridges 386, 388. Whereas ridges 186 are diametrically opposed from each other and extend in a clockwise direction (looking from above) with respect to through-opening 184, ridges 386, 388 are both located on the same side of inner member 350 relative to eyelets 368, 370 such that ridge 386 extends in a clockwise direction (looking from above) with respect to its through-opening 384, while ridge 388 extends in a counter-clockwise direction (looking from above) with respect to its through-opening 384. The opposing directions allow inner member 350 to lock with outer member 310 regardless of the direction in which assembly 300 is being rotated.

Figure 14:
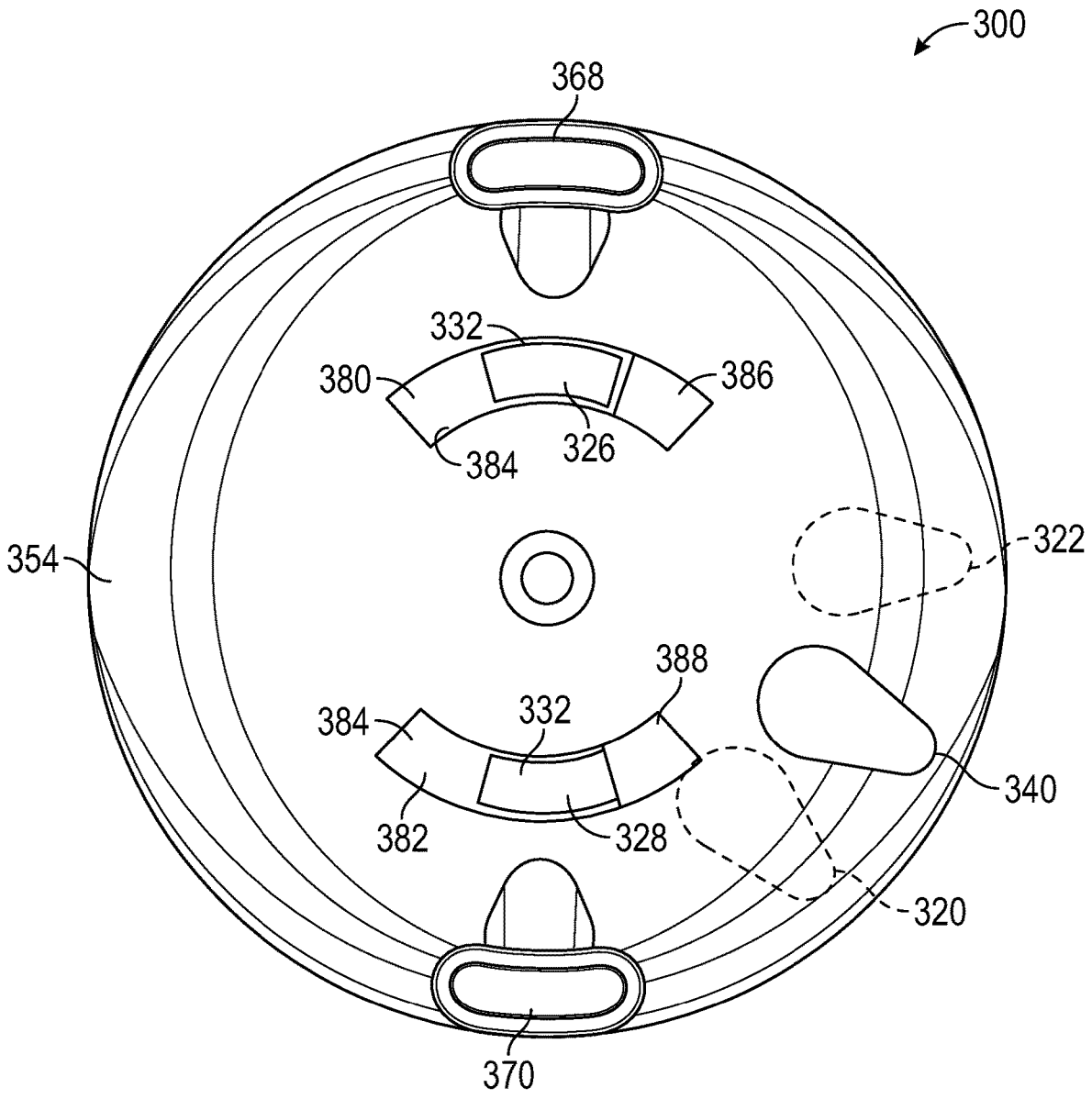
FIG. 14 is a top plan view of the assembly, with the inner member inserted into the outer member.
Figure 15:
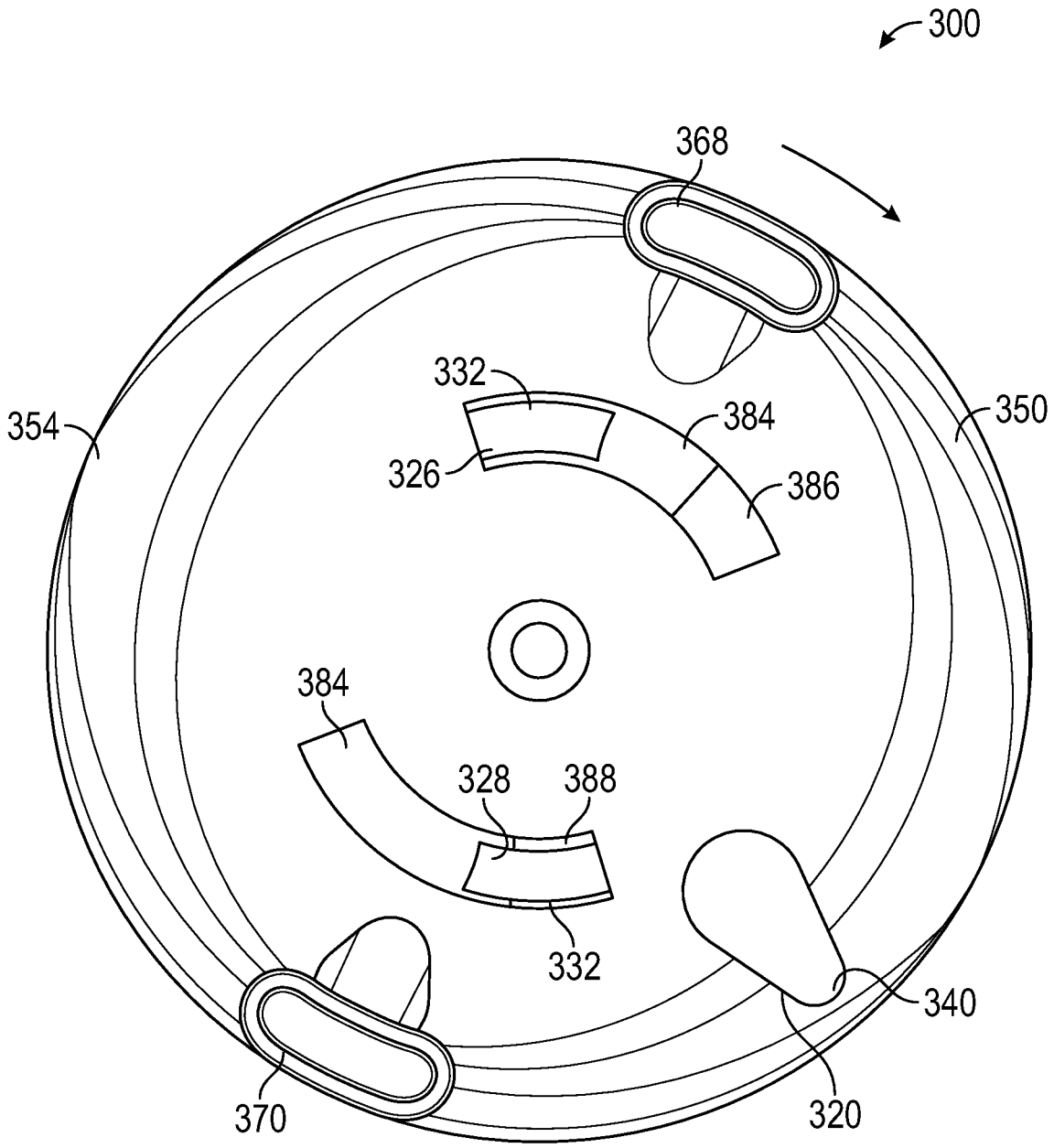
FIG. 15 is a top plan view of the assembly, with the inner member rotated clockwise with respect to the outer member.

To use assembly 300, inner member 350 is inserted into outer member 310 so that clamps 326, 328 are inserted through through-openings 384 in upper plate 354 as shown in FIG. 14. Assembly 300 is then inserted into soil and rotated in a clockwise direction. Inner member 350 rotates relative to inner member 310 to the position shown in FIG. 15, where clamp 328 engages its respective ridge 388 and locks inner member 350 to outer member 310 so that both members 310, 350 rotate together as outer member augers into the soil. In this condition, teardrop shaped opening 340 aligns with teardrop shaped opening 320. Once assembly 300 is inserted into the soil, a beach chair (not shown) of other article can be secured to assembly 300 in the same manner as described above with respect to assembly 100.

Figure 16:
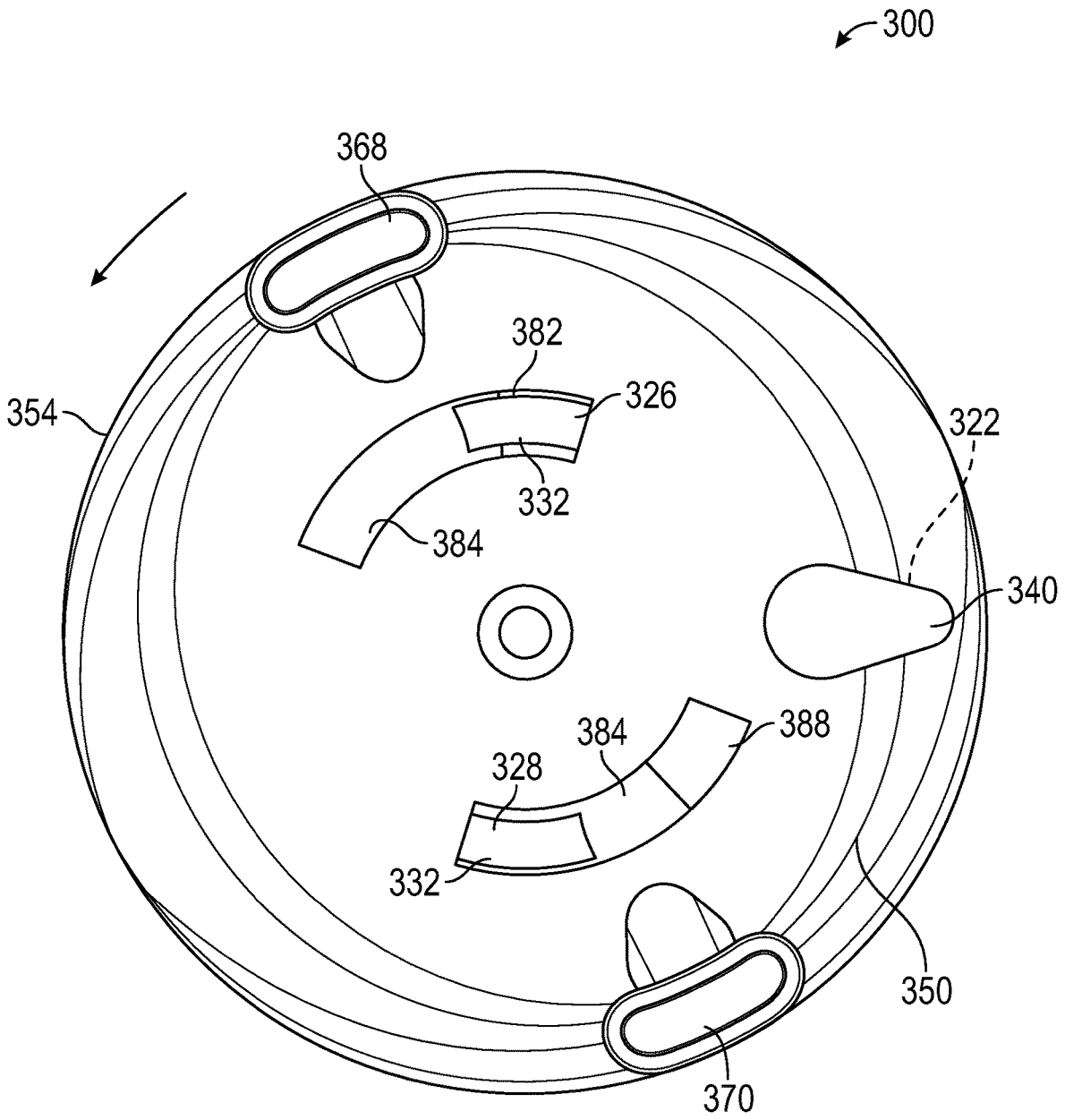
FIG. 16 is a top plan view of the assembly, with the inner member rotated counter-clockwise with respect to the outer member.

To unscrew assembly 300 from the soil, the beach chair or other article is removed from assembly 300 and inner member 350 is rotated counter-clockwise to the position shown in FIG. 16. Clamp 326 engages its respective ridge 386 and locks inner member 350 to outer member 310 so that both members 310, 350 rotate together as outer member augers out of the soil. In this condition, teardrop shaped opening 340 aligns with teardrop shaped opening 322.

When assembly 300 is removed, a carabiner clip (not shown) or other securing device can be clamped to assembly through either the combination of teardrop shaped openings 320, 340 or 322, 340 to keep assembly 300 together.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A beach chair securing assembly comprising:

an outer insert having:

a hollow leg, the hollow leg having a pointed distal tip and a proximal opening, the hollow leg having a helical thread assembly surrounding an exterior thereof and extending partially up the length of the leg; and a lower plate surrounding the proximal opening, the lower plate having a pair of clamps, each clamp including a vertical portion extending upwardly from the lower plate and a connecting horizontal portion extending generally parallel to the lower plate; and an inner insert having:

a distal shaft sized to fit into the hollow leg; and an upper plate connected to the distal shaft, the upper plate having:

a top surface having a saddle defined by a generally arcuate concave valley extending along a longitudinal axis;

a pair of diametrically opposed ridges extending upwardly from either side of the valley, each ridge including an upwardly extending eyelet, each eyelet having a through-hole extending therethrough such that the through-holes are axially aligned; and a pair of diametrically opposed catches sized and shaped to engage one of the clamps.

2. The beach chair securing assembly according to claim 1, wherein the helical thread assembly comprises a double helix.

3. The beach chair securing assembly according to claim 1, wherein the lower plate has a lower cutout and wherein the upper plate has an upper cutout such that, when the inner insert is inserted into the outer insert and the catches are engaged with the clamps, the upper cutout is aligned with the lower cutout.

4. The beach chair securing assembly according to claim 1, wherein the catches extend along the longitudinal axis.

5. The beach chair securing assembly according to claim 1, wherein the clamps are diametrically opposed from each other.

6. The beach chair securing assembly according to claim 1, wherein the ridges are both located on the same side of inner member relative to the eyelets.

7. The beach chair securing assembly according to claim 6, wherein, when the upper plate is rotated clockwise relative to the lower plate, one of the catches engages one of the clamps and, wherein when the upper plate is rotated counterclockwise relative to the lower plate, the other of the catches engages the other of the clamps.

8. The beach chair securing assembly according to claim 1, wherein the lower plate has a generally annular or scalloped shape.

9. A beach chair securing assembly comprising:

an outer insert having:

a hollow leg, the hollow leg having a pointed distal tip and a proximal opening, the hollow leg having a helical thread assembly extending partially up the length of the leg; and a lower plate surrounding the proximal opening, the lower plate having a pair of clamps, each clamp including a vertical portion extending upwardly from the lower plate and a connecting horizontal portion extending generally parallel to the lower plate; and an inner insert having:

a distal shaft sized to fit into the hollow leg; and an upper plate connected to the distal shaft, the upper plate having:

a top surface;

a pair of diametrically opposed ridges extending upwardly from either the top surface, each ridge including an upwardly extending eyelet, each eyelet having a through-hole extending therethrough such that the through-holes are axially aligned; and a pair of diametrically opposed catches sized and shaped to engage one of the clamps.

10. The beach chair securing assembly according to claim 9, wherein the inner insert is rotatable relative to the outer insert to engage each of the clamps with a respective one of the catches.

11. The beach chair securing assembly according to claim 10, wherein the inner insert is rotatable in each of a clockwise and a counter-clockwise direction relative to the outer insert.

12. The beach chair securing assembly according to claim 9, wherein the top surface comprises a saddle shape between the eyelets.

13. The beach chair securing assembly according to claim 9, wherein the upper plate has an upper cutout and wherein the lower plate has a lower cutout such that, when the inner insert is inserted into the outer insert, the upper cutout is aligned with the lower cutout.

14. The beach chair securing assembly according to claim 13, wherein the lower plate has two cutouts.

15. The beach chair securing assembly according to claim 13, wherein the cutouts each have a teardrop shape.

16. The beach chair securing assembly according to claim 13, wherein the upper cutout and the lower cutout have the same size and shape.

17. The beach chair securing assembly according to claim 9, wherein each catch comprises a generally arcuate through-opening sized to allow one of the clamps to extend therethrough.

18. The beach chair securing assembly according to claim 17, wherein each catch further comprises a recessed ridge adjacent to a respective through-opening.

* * * * *